US010415786B2

(12) United States Patent
Ahn et al.

(10) Patent No.: US 10,415,786 B2
(45) Date of Patent: Sep. 17, 2019

(54) PIXEL LIGHT HEADLAMP FOR VEHICLES

(71) Applicants: Hyundai Motor Company, Seoul (KR); Kia Motors Corporation, Seoul (KR)

(72) Inventors: Byoung Suk Ahn, Gwacheon-si (KR); Jik Soo Shin, Incheon (KR); Keun Sig Lim, Yongin-si (KR); Jung Wook Lim, Seoul (KR); Ki Hong Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 112 days.

(21) Appl. No.: 15/631,970

(22) Filed: Jun. 23, 2017

(65) Prior Publication Data

US 2018/0172235 A1 Jun. 21, 2018

(30) Foreign Application Priority Data

Dec. 16, 2016 (KR) ..... 10-2016-0172462

(51) Int. Cl.
*F21S 41/675* (2018.01)
*F21S 41/275* (2018.01)
(Continued)

(52) U.S. Cl.
CPC ..... *F21S 41/675* (2018.01); *F21S 41/16* (2018.01); *F21S 41/176* (2018.01);
(Continued)

(58) Field of Classification Search
CPC ..... F21S 48/1757; F21S 48/1283; F21S 48/1358; F21S 41/675; F21S 41/275;
(Continued)

(56) References Cited

U.S. PATENT DOCUMENTS

2011/0188258 A1 8/2011 Tajima
2017/0305330 A1* 10/2017 Park ..... F21V 7/05
(Continued)

FOREIGN PATENT DOCUMENTS

JP 2008-123856 A 5/2008
KR 10-2009-0096994 A 9/2009
KR 10-2011-0057834 A 6/2011

*Primary Examiner* — Y M. Lee
(74) *Attorney, Agent, or Firm* — Morgan, Lewis & Bockius LLP

(57) ABSTRACT

A pixel light headlamp for a vehicle may include a light source module, a digital micro-mirror device (DMD) optical system, an imaging lens module, wherein the condenser lens includes a first condenser lens disposed between the light source and the phosphor and second and third condenser lenses which are disposed on a path through which light emitted from the first condenser lens is incident on the DMD chip; the second condenser lens is disposed to face the phosphor; the third condenser lens is disposed to be distanced from the second condenser lens such that it is not overlapped with a moving path of light emitted from the phosphor; and the light source and the first condenser lens as well as the DMD chip and the imaging lens module are configured to tilt with respect to a lens housing.

7 Claims, 8 Drawing Sheets

(51) Int. Cl.

| | |
|---|---|
| ***F21S 41/33*** | (2018.01) |
| ***F21S 41/265*** | (2018.01) |
| ***F21S 41/657*** | (2018.01) |
| ***F21S 41/16*** | (2018.01) |
| ***F21S 41/365*** | (2018.01) |
| ***F21S 41/176*** | (2018.01) |

(52) U.S. Cl.
CPC ..... *F21S 41/265* (2018.01); *F21S 41/275* (2018.01); *F21S 41/334* (2018.01); *F21S 41/365* (2018.01); *F21S 41/657* (2018.01)

(58) Field of Classification Search
CPC ..... F21S 41/176; F21S 41/265; F21S 41/365; F21S 41/16; F21S 41/334; F21S 41/657; F21V 5/008; F21V 5/10; F21V 13/02; F21V 13/08; F21V 5/04
See application file for complete search history.

(56) References Cited

U.S. PATENT DOCUMENTS

| | | | | |
|---|---|---|---|---|
| 2018/0031202 | A1* | 2/2018 | Bhakta ..... | F21S 41/675 |
| 2018/0106455 | A1* | 4/2018 | Uchida ..... | F21S 41/176 |
| 2018/0147978 | A1* | 5/2018 | Reisinger ..... | F21S 41/16 |
| 2018/0304808 | A1* | 10/2018 | Hebenstreit ..... | B60Q 11/005 |

* cited by examiner

PIXEL LIGHT HEADLAMP FOR VEHICLES

CROSS-REFERENCE(S) TO RELATED APPLICATIONS

The present application claims priority to Korean Patent Application No. 10-2016-0172462 filed on Dec. 16, 2016, the entire contents of which is incorporated herein for all purposes by this reference.

BACKGROUND OF THE INVENTION

Field of the Invention

The present invention relates to a pixel light headlamp for a vehicle and more particularly, to a pixel light headlamp for a vehicle which is capable of performing both a function of securing the front visual field and a function of displaying contents on a road surface by means of a single pixel light module.

Description of Related Art

The headlamp of a vehicle is configured to illuminate the front of the vehicle and is one of many safety devices configured to prevent accidents by allowing for a wide range of the front visual field of a driver through such illumination, wherein a beam pattern implemented by the headlamp may be a low beam (LB) mode, a high beam (HB) mode, or an adaptive driving beam (ADB) mode.

The ADB mode is a type of beam pattern implemented in an intelligent headlamp and is a mode in which the direction and angle illuminating light are automatically controlled according to the driving conditions. ADB mode is a technology that detects a preceding vehicle through a camera detector and converts the HB mode to the LB mode and vice versa automatically. Specifically, ADB mode is a technology designed to prevent glare of a driver in an opponent vehicle from occurring by converting the HB mode to the LB mode or forming a shadow zone when an opponent vehicle appears while the HB is on.

Further, as an example of an intelligent headlamp, a technology has been developed that displays contents (e.g., indication of a crosswalk, indication of position of a pedestrian, etc.) on a road surface in front of the running vehicle to show the contents to the drivers of other vehicles or pedestrians.

Displaying contents by means of headlamps is a technology that subdivides light-on or off areas into pixels and controls the light-on or off areas subdivided into pixels to be separately turned on or off depending on shape of the contents (i.e., information) provided onto each position or a road surface, which can be implemented by means of a conventional digital micro-mirror device (DMD) chip.

The DMD chip has hundreds of thousands of micro-mirrors arranged in a form of a checkerboard, wherein the micro-mirror is a multilayer metal carrying an electrical signal, has a function of reflecting the incident light, and performs an individual tilting operation at very high speed in response to a digital input signal by a pulse width modulation (PWM) method.

That is, the micro-mirror can perform a tilting operation that rotates by +12 degrees or −12 degrees in response to on or off state of the digital input signal and adjust the brightness of light to be illuminated using a ratio of time staying in the on-state and time staying in the off-state.

In a headlamp having a DMD optical system, a beam pattern (e.g., low beam, high beam, ADB, etc.) irradiated to the outside is implemented through the individual tilting operation of micro-mirrors corresponding to each pixel. By using such a function, it is possible to display any necessary contents (i.e., information) on a road surface in front of a running vehicle.

As described above, a conventional headlamp capable of performing both a function of securing the front visual field of an own running vehicle and a function of displaying contents (i.e., information) on the road surface is configured to have two pixel light modules, i.e., one pixel light module that performs the function of securing the front visual field and another pixel light module that performs the function of displaying the contents (i.e., information) on the road surface. The present system has the drawbacks in that structure thereof is complicated, weight is heavy, and the cost is high.

Although it is possible to configure another system capable of performing both a function of securing the front visual field of an own vehicle and a function of displaying contents (i.e., information) on a road surface by means of a single pixel light module, it is necessary to develop a technology that can secure sufficient amount of light when performing the both functions.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a headlamp implementing pixel light by a DMD optical system, particularly a pixel light headlamp for a vehicle configured for performing both a function of securing the front visual field of an own vehicle and a function of displaying contents (i.e., information) on a road surface by a single pixel light module, and at the same time securing a sufficient amount of light when performing both functions.

A pixel light headlamp for a vehicle according to an exemplary embodiment of the present invention for accomplishing the aspect as mentioned above includes a light source module including a light source, a plurality of condenser lenses, and a phosphor; a DMD optical system including the light source module and a DMD chip having micro-mirrors; and an imaging lens module configured for projecting light reflected by the DMD optical system forward, wherein the condenser lens includes a first condenser lens disposed between the light source and the phosphor, and second and third condenser lenses disposed on a path through which light emitted from the first condenser lens is incident on the DMD chip; the second condenser lens is disposed to face the phosphor; the third condenser lens is disposed to be distanced from the second condenser lens such that the third condenser lens is not overlapped with a moving path of light emitted from the phosphor; and the light source and the first condenser lens as well as the DMD chip and the imaging lens module are configured to tilt with respect to a lens housing.

The present invention further includes a reflection mirror disposed between the light source module and the DMD chip to reflect light emitted from the light source module to the micro-mirrors of the DMD chip.

The phosphor and the second and third condenser lenses are configured to be fixed to the lens housing fixed to a vehicle body; the light source, first condenser lens, DMD chip, reflection mirror, and the imaging lens module are configured to be fixed to a tilt housing separated from the lens housing. The tilt housing is configured to be connected to an actuator fixed to the lens housing wherein the tilt housing can tilt at a predetermined angle with respect to the lens housing with the aid of operation of the actuator.

The imaging lens module includes a plurality of lenses disposed wherein an optical axis formed by connecting centers of the lenses yields a straight line. The tilt housing is configured to tilt about a pivot axis perpendicular to the optical axis while passing through the center of a light incident surface of a lens positioned at the forefront in the imaging lens module.

The tilt housing tilts wherein the center of a light emitting surface of the first condenser lens coincides with the center of a light incident surface of the third condenser lens in the situation where the center of the light emitting surface of the first condenser lens coincides with the center of a light incident surface of the phosphor, or such that the center of the light emitting surface of the first condenser lens coincides with the center of the light incident surface of the phosphor in the situation where the center of the light emitting surface of the first condenser lens coincides with the center of the light incident surface of the third condenser lens.

When the tilt housing tilts wherein the center of the light emitting surface of the first condenser lens coincides with the center of the light incident surface of the phosphor, white light emitted from the light source is converted into yellow light while passing through the phosphor. The yellow light emitted from the phosphor is irradiated to the front of the own vehicle through the DMD optical system and the imaging lens module to be implemented as a LB mode, a HB mode, or an ADB mode for securing the front visual field.

Further, when the tilt housing tilts wherein the center of the light emitting surface of the first condenser lens coincides with the center of the light incident surface of the third condenser lens, the white light emitted from the light source is directly incident on the third condenser lens. The white light emitted from the third condenser lens is irradiated onto the road surface in front of the vehicle in the traveling direction through the DMD optical system and the imaging lens module, and at the same time displays contents on the road surface by separate tilting operation of the micro-mirrors.

According to an exemplary embodiment of the present invention, there are advantageous effects that an assembly of the light source module, the DMD optical system, and the imaging lens module forms a single pixel light module, and that both a function of securing the front visual field including a LB mode, a HB mode, and an ADB mode of an own vehicle and a function of displaying contents on a road surface can be performed by the single pixel light module, and, particularly, a sufficient amount of light can be secured through the tilting operation of the light source, the first condenser lens, the DMD chip, the reflection mirror, and the imaging lens module when the two functions are performed.

Particularly, when autonomous vehicles come into wide use, the present invention can provide the contents of various information onto a road surface in front of a vehicle in a traveling direction, and therefore greatly contribute to more safe autonomous driving and protection of pedestrians.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
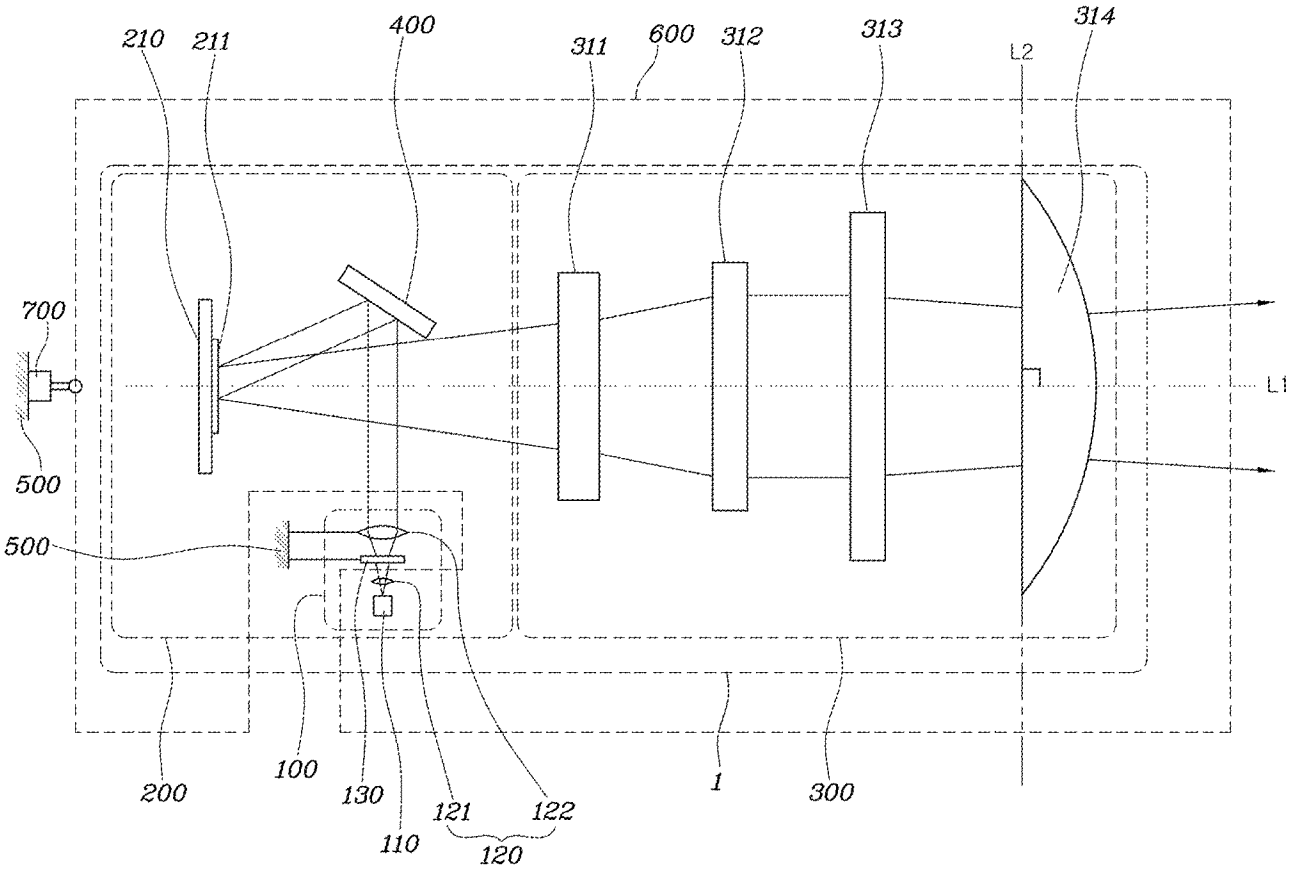
FIG. 1, FIG. 2, FIG. 3, and FIG. 4 are views for illustrating a state in which the front visual field of an own vehicle is secured by a pixel light headlamp for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is intended to cover not only the exemplary embodiments, but also various alternatives, modifications, equivalents and other embodiments, which may be included within the spirit and scope of the invention as defined by the appended claims.

As shown in FIG. 1 to FIG. 8, a pixel light headlamp according to an exemplary embodiment of the present invention includes a light source module 100 including a light source 110, a plurality of condenser lenses 120, and a phosphor 130; a DMD optical system 200 including the light source module 100 and a DMD chip 210 having micro-mirrors 211; and an imaging lens module 300 for projecting the light reflected by the DMD optical system 200 forward thereof.

An assembly of the light source module 100, the DMD optical system 200, and the imaging lens module 300 forms one pixel light module 1.

The light source 110 is a laser diode that outputs white light.

The condenser lenses 120 includes a first condenser lens 121 disposed between the light source 110 and the phosphor 130, and second and third condenser lenses 122, 123 which are disposed on a path through which the light emitted from the first condenser lens 121 is incident on the DMD chip 210.

The present invention further includes a reflection mirror 400 disposed between the light source module 100 and the DMD chip 210 configured to reflect light emitted from the light source module 100 towards the micro-mirrors 211 of the DMD chip 210.

When a possible embodiment of the present invention is configured wherein the light emitted from the light source module 100 is directly incident on the micro-mirrors 211, the reflection mirror 400 is not required in such an embodiment. However, the present embodiment of the invention will be described herein on a basis of a configuration in which the reflection mirror 400 is provided.

The first condenser lens 121 is configured to condense white light emitted from the light source 110 and allow the light to be incident on the phosphor 130, the second condenser lens 122 is configured to condense yellow light emitted from the phosphor 130 and allow the light to be incident on the reflection mirror 400, and the third condenser lens 123 is configured to condense white light emitted from the light source 110 and allow the light to be incident on the reflection mirror 400.

In other words, the second condenser lens 122 is disposed to face the phosphor 130 and the third condenser lens 123 is disposed to be distanced from the second condenser lens 122 wherein it is not overlapped with a moving path of the light emitted from the phosphor 130. Accordingly, when the light source 110 and the first condenser lens 121 face the phosphor 130, the light emitted from the light source 110 is incident on the reflection mirror 400 through the first condenser lens 121, the phosphor 130 and the second condenser lens 122. When the light source 110 and the first condenser lens 121 face the third condenser lens 123 rather than the phosphor 130, the light emitted from the light source 110 is incident on the reflection mirror 400 through the first and third condenser lenses 121, 123.

To allow the light emitted from the first condenser lens 121 to be incident on the phosphor 130 or the third condenser lens 123, the light source 110 and the first condenser lens 121, the DMD chip 210, the reflection mirror 400 and the imaging lens module 300 are configured to be fixed to a tilt housing 600 separated from a lens housing 500.

In other words, the phosphor 130 and the second and third condenser lenses 122, 123 are configured to be fixed to the lens housing 500 fixed to a vehicle body while the light source 110, first condenser lens 121, DMD chip 210, reflection mirror 400, and the imaging lens module 300 are configured to be fixed to the tilt housing 600 separated from the lens housing 500. The tilt housing 600 is configured to be connected to an actuator 700 fixed to the lens housing 500 wherein it can tilt at a predetermined angle with respect to the lens housing 500 with the aid of operation of the actuator 700.

The actuator 700 is configured to be operated under the control of an electronic control unit (ECU) disposed in the vehicle.

The imaging lens module 300 includes a plurality of lenses disposed wherein an optical axis L1 formed by connecting centers of the lenses becomes a straight line. The imaging lens module includes first to fourth imaging lenses 311 to 314, but not limited thereto.

The first imaging lens 311 may include a double lens configured for correcting chromatic aberration, while the second imaging lens 312 and the third imaging lens 313 may be configured to adjust the focus and size of the light reflected from the DMD chip 210 to the present end, any one of the second imaging lens 312 and the third imaging lens 313 may be configured wherein its position can be changed in forward and backward directions with the aid of a separate actuating mechanism. The fourth imaging lens 314 may be an aspherical lens configured for correcting distortion of light.

The tilt housing 600 is configured wherein it can tilt about a pivot axis L2 perpendicular to the optical axis L1 while passing through the center of a light incident surface of a lens positioned at the forefront, i.e., the fourth imaging lens 314 in the imaging lens module 300 as described above.

Figure 2:
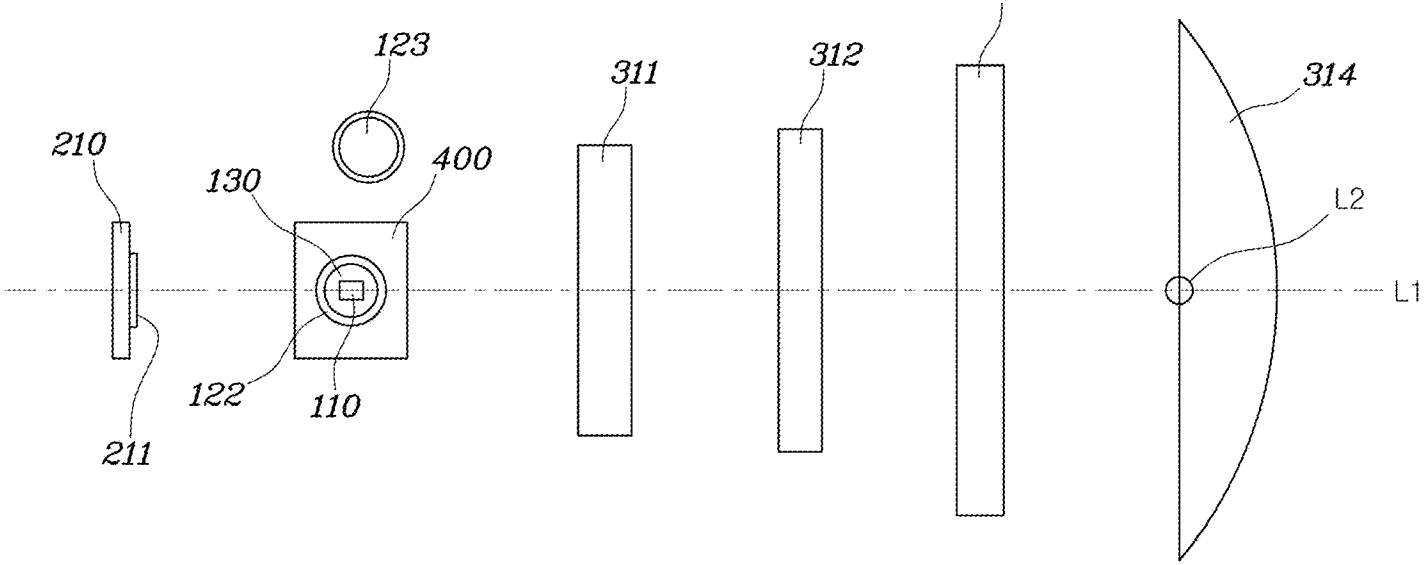
Figure 3:
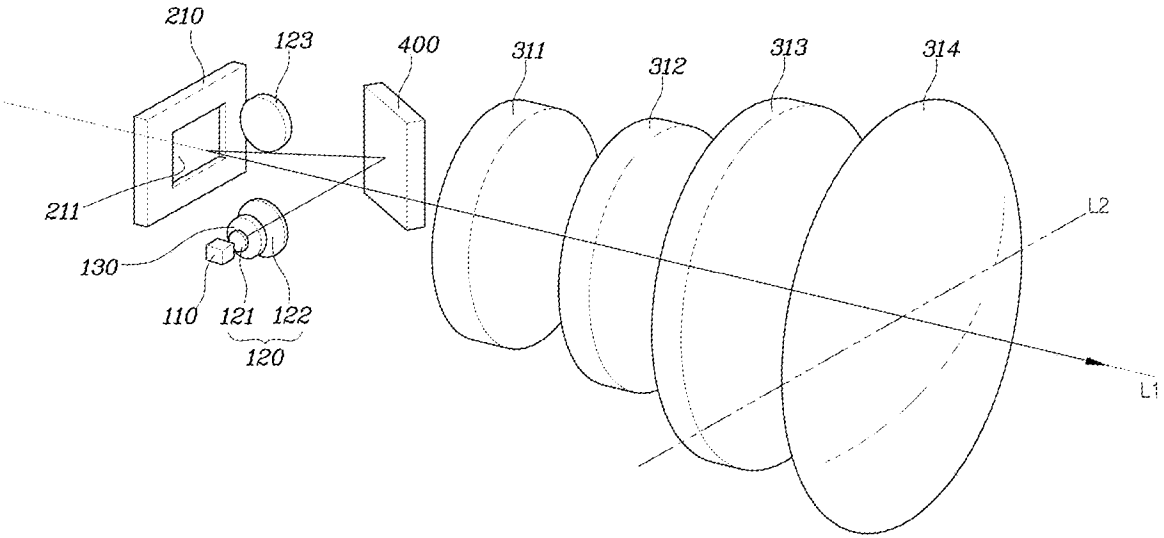
Figure 5:
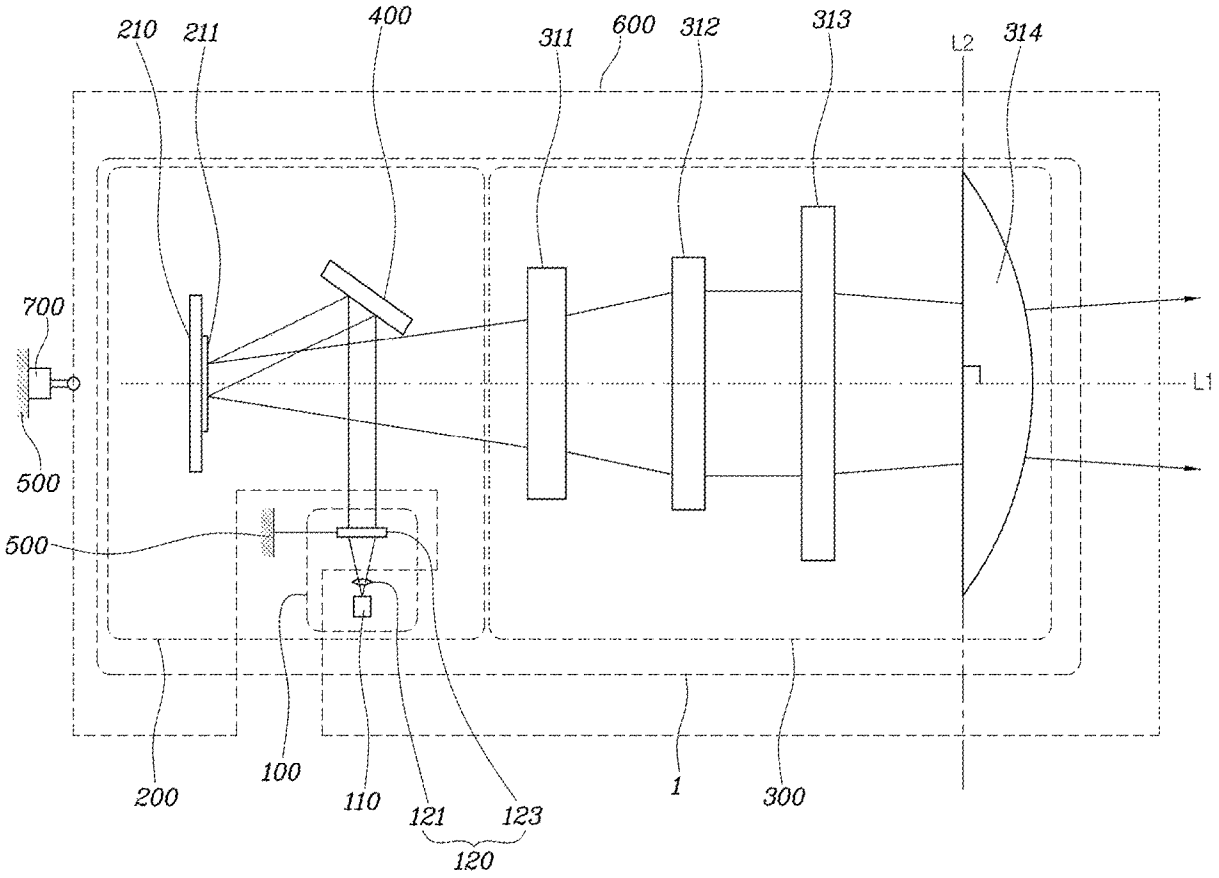
FIG. 5, FIG. 6, FIG. 7, and FIG. 8 are views for illustrating a state in which contents are displayed on a road surface in front of an own vehicle by a pixel light headlamp for a vehicle according to an exemplary embodiment of the present invention.
Figure 6:
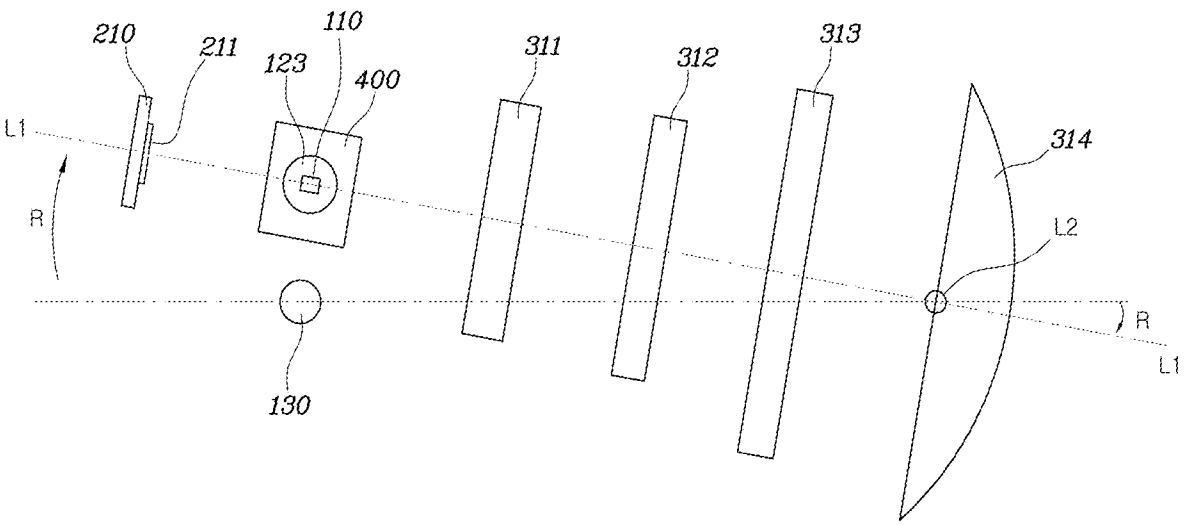
Figure 7:
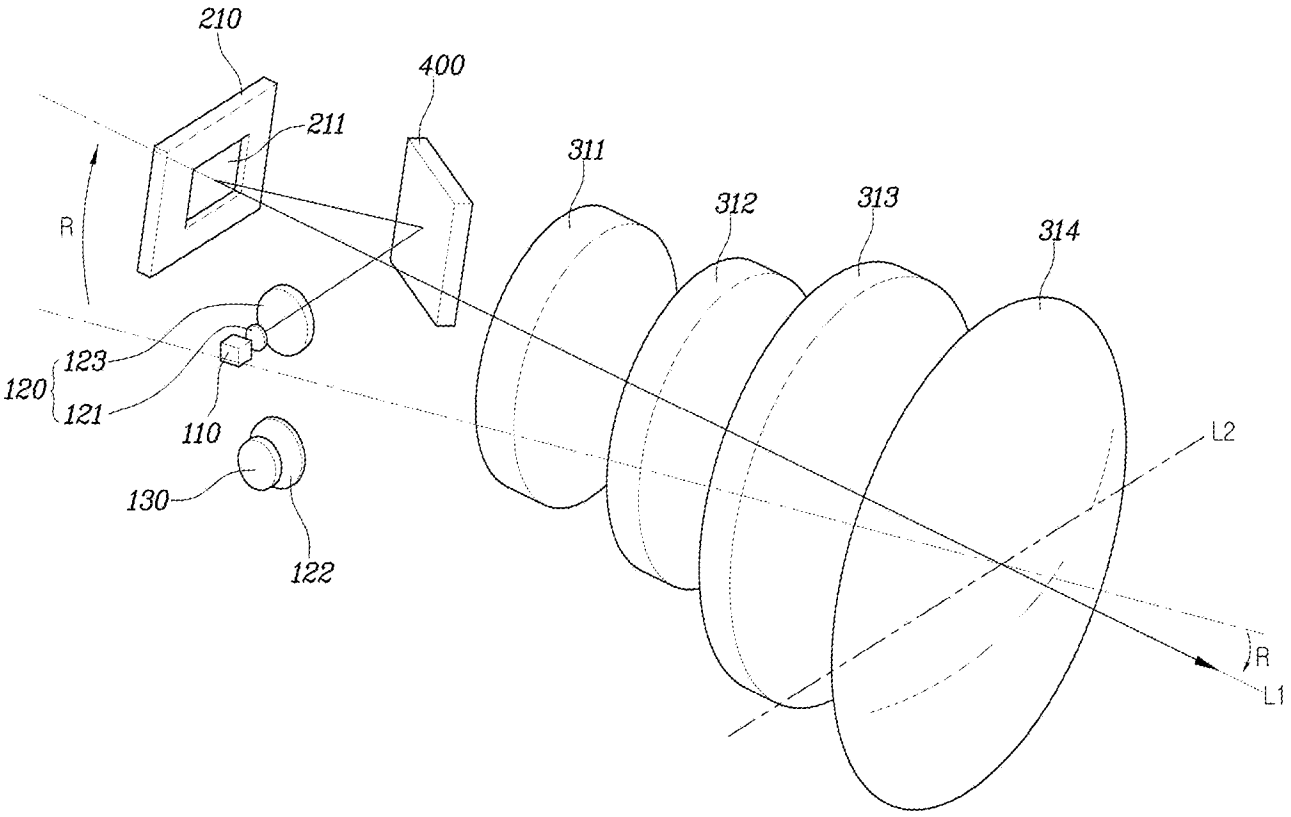
Figure 8:
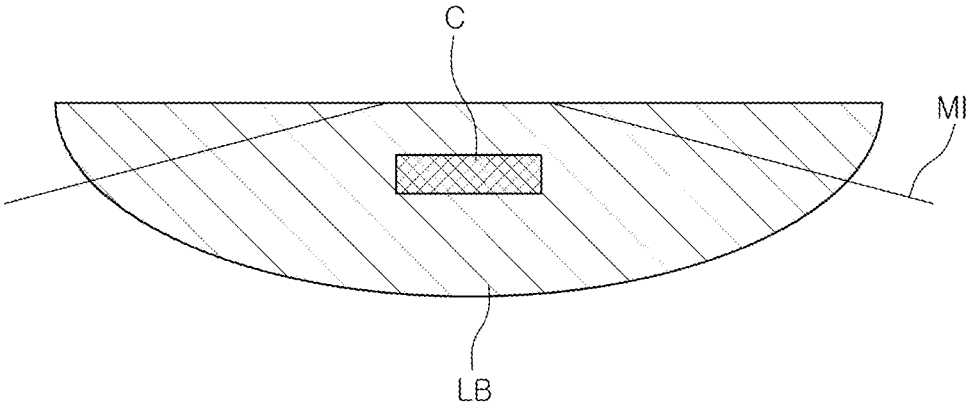

That is, the tilt housing 600 can tilt such that the center of a light emitting surface of the first condenser lens 121 coincides with the center of a light incident surface of the third condenser lens 123 as shown in FIG. 5 to FIG. 7 in the situation where the center of the light emitting surface of the first condenser lens 121 coincides with the center of a light incident surface of the phosphor 130 as shown in FIG. 1, FIG. 2, and FIG. 3.

Conversely, the tilt housing can tilt such that the center of the light emitting surface of the first condenser lens 121 coincides with the center of the light incident surface of the phosphor 130 as shown in FIG. 1 to FIG. 3, or in the situation where the center of the light emitting surface of the first condenser lens 121 coincides with the center of the light incident surface of the third condenser lens 123 as shown in FIG. 5 to FIG. 7.

Figure 4:
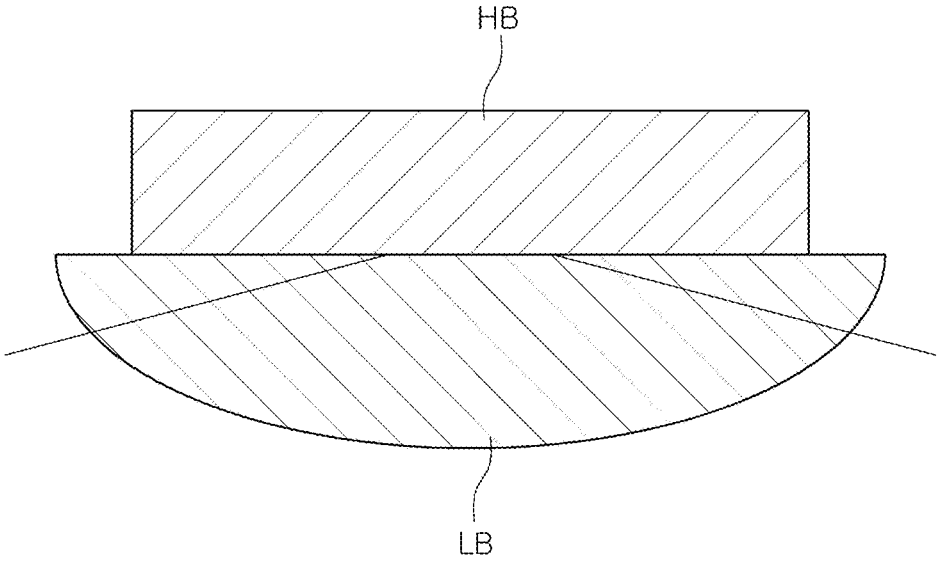

On the other hand, when the tilt housing tilts wherein the center of the light emitting surface of the first condenser lens 121 coincides with the center of the light incident surface of the phosphor 130 as shown in FIG. 1 to FIG. 3, white light emitted from the light source 110 is condensed in the first condenser lens 121 and incident on the phosphor 130 where it is excited to yellow light. The excited yellow light is condensed through the second condenser lens 122 and reflected through the reflection mirror 400 and the micro-mirrors 211 of the DMD chip 210, and in turn irradiated to the front of the own vehicle through the imaging lens module 300. At the present time, the yellow light irradiated to the front of the vehicle is implemented as a LB mode, a HB mode, or an ADB mode for securing the visual field, as shown in FIG. 4.

Further, when the tilt housing 600 is rotated about the pivot axis L2 and tilted with respect to the lens housing 500 at a predetermined angle by driving the actuator 700 wherein the center of the light emitting surface of the first condenser lens 121 coincides with the center of the light incident surface of the third condenser lens 123. White light emitted from the light source 110 is directly incident on the third condenser lens 123 and in turn condensed, while white light emitted from the third condenser lens 123 is reflected on the reflection mirror 400 and the micro-mirrors 211 of the DMD chip 210, and then irradiated onto the road surface in front of the vehicle in the traveling direction through the imaging lens module 300. At the present time, only the LB is irradiated to the front of the vehicle wherein the front visual field is secured as shown in FIG. 5 and at the same time, contents C having information (e.g., indication of a crosswalk, indication of position of a pedestrian, etc.) specified to drivers of other vehicles or pedestrians are displayed on the front road surface M1 by separate tilting operation of the micro-mirrors 211.

As described above, the present exemplary embodiment of the present invention is advantageous in that an assembly of the light source module 100, the DMD optical system 200 and the imaging lens module 300 forms a single pixel light module 1; both a function of securing the front visual field including a LB mode, a HB mode, and an ADB mode of an own vehicle, and a function of displaying the contents C on the road surface M1 can be performed by the single pixel light module 1, and, particularly, a sufficient amount of light can be secured through the tilting operation of the light source 110, first condenser lens 111, DMD chip 210, reflection mirror 400, and the imaging lens module 300 when the two functions are performed.

Particularly, when autonomous vehicles come into wide use, the system according to an exemplary embodiment of the present invention can provide contents C of various information onto the road surface M1 in front of the vehicle in a traveling direction, and therefore will be a great help in safe autonomous driving and protection of pedestrians.

For convenience in explanation and accurate definition in the appended claims, the terms "upper", "lower", "internal", "outer", "up", "down", "upwards", "downwards", "front", "back", "rear", "inside", "outside", "inwardly", "outwardly", "internal", "external", "forwards", "backwards" are used to describe features of the exemplary embodiments with reference to the positions of such features as displayed in the figures.

The foregoing descriptions of specific exemplary embodiments of the present invention have been presented for purpose of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A pixel light headlamp apparatus for a vehicle comprising:

a light source module including a light source, a plurality of condenser lenses and a phosphor;

a digital micro-mirror device (DMD) optical system including the light source module and a DMD chip having micro-mirrors; and an imaging lens module for projecting light reflected by the DMD optical system forward, wherein the condenser lens includes a first condenser lens disposed between the light source and the phosphor and second and third condenser lenses which are disposed on a path through which light emitted from the first condenser lens is incident on the DMD chip;

wherein the second condenser lens is disposed to face the phosphor;

wherein the third condenser lens is disposed to be distanced from the second condenser lens such that the third condenser lens is not overlapped with a moving path of light emitted from the phosphor; and wherein the light source and the first condenser lens as well as the DMD chip and the imaging lens module are configured to tilt with respect to a lens housing.

2. The pixel light headlamp apparatus of claim 1, further comprising a reflection mirror disposed between the light source module and the DMD chip to reflect light emitted from the light source module to the micro-mirrors of the DMD chip.

3. The pixel light headlamp apparatus of claim 2, wherein the phosphor and the second and third condenser lenses are configured to be fixed to the lens housing fixed to a vehicle body; the light source and the first condenser lens as well as the DMD chip, the reflection mirror and the imaging lens module are configured to be fixed to a tilt housing separated from the lens housing; and the tilt housing is configured to be connected to an actuator fixed to the lens housing such that the tilt housing is tiltable at a predetermined angle with respect to the lens housing with operation of the actuator.

4. The pixel light headlamp apparatus of claim 3, wherein the imaging lens module includes a plurality of lenses disposed such that an optical axis formed by connecting centers of the lenses are configured to be a straight line, and wherein the tilt housing is configured to tilt about a pivot axis perpendicular to the optical axis while passing through a center of a light incident surface of a lens disposed at a forefront in the imaging lens module.

5. The pixel light headlamp apparatus of claim 3, wherein the tilt housing tilts such that a center of a light emitting surface of the first condenser lens coincides with a center of a light incident surface of the third condenser lens when a center of the light emitting surface of the first condenser lens coincides with a center of a light incident surface of the phosphor, or such that a center of the light emitting surface of the first condenser lens coincides with a center of the light incident surface of the phosphor when a center of the light emitting surface of the first condenser lens coincides with a center of the light incident surface of the third condenser lens.

6. The pixel light headlamp apparatus of claim 5, wherein when the tilt housing tilts such that a center of the light emitting surface of the first condenser lens coincides with a center of the light incident surface of the phosphor, white light emitted from the light source is converted into yellow light while passing through the phosphor and the yellow light emitted from the phosphor is irradiated to a front of a own vehicle through the DMD optical system and the imaging lens module to be implemented as a low beam mode, a high beam mode, or an adaptive driving beam (ADB) mode for securing a front visual field.

7. The pixel light headlamp apparatus of claim 5, wherein when the tilt housing tilts such that a center of the light emitting surface of the first condenser lens coincides with a center of the light incident surface of the third condenser lens, white light emitted from the light source is directly incident on the third condenser lens and white light emitted from the third condenser lens is irradiated onto the road surface in a front of the vehicle in the traveling direction through the DMD optical system and the imaging lens module and at the same time displays contents on a road surface by separate tilting operation of the micro-mirrors.

* * * * *